US007845966B2

(12) United States Patent
Rioufreyt et al.

(10) Patent No.: US 7,845,966 B2
(45) Date of Patent: Dec. 7, 2010

(54) DEVICE FOR PROTECTING THE ENGAGEABLE ELEMENTS OF A CONNECTOR

(75) Inventors: Philippe Rioufreyt, Sevres (FR); Michel Nollet, Noisy le Roi (FR)

(73) Assignee: Sagem Defense Securite, Paris (FR)

( * ) Notice: Subject to any disclaimer, the term of this patent is extended or adjusted under 35 U.S.C. 154(b) by 221 days.

(21) Appl. No.: 12/127,302

(22) Filed: May 27, 2008

(65) Prior Publication Data

US 2008/0299814 A1 Dec. 4, 2008

(30) Foreign Application Priority Data

May 30, 2007 (FR) ..... 07 03834

(51) Int. Cl.
*H01R 13/62* (2006.01)

(52) U.S. Cl. ..... 439/367; 439/137

(58) Field of Classification Search ..... 439/367, 439/136, 137, 141, 191, 192, 194, 205, 206
See application file for complete search history.

(56) References Cited

U.S. PATENT DOCUMENTS 4,373,767 A * 2/1983 Cairns
4,411,491 A * 10/1983 Larkin et al.
4,606,603 A * 8/1986 Cairns
4,682,848 A * 7/1987 Cairns et al. ..... 385/69
4,756,595 A * 7/1988 Braun et al.
4,887,883 A * 12/1989 Darbut et al.
5,125,056 A * 6/1992 Hughes et al.
5,171,158 A * 12/1992 Cairns
5,203,805 A * 4/1993 Cairns ..... 439/199
6,039,585 A * 3/2000 Kim et al.
6,315,461 B1 * 11/2001 Cairns
6,464,405 B2 * 10/2002 Cairns et al. ..... 385/56
6,736,545 B2 * 5/2004 Cairns et al.
6,910,910 B2 * 6/2005 Cairns ..... 439/352
7,137,843 B1 11/2006 Munoz
7,244,132 B1 * 7/2007 Cairns et al. ..... 439/191
7,344,316 B2 * 3/2008 McKinnon
7,364,448 B2 * 4/2008 Cairns et al. ..... 439/201
7,530,744 B2 * 5/2009 Prel et al.
2002/0003931 A1 * 1/2002 Cairns et al. ..... 385/56
2003/0007738 A1 * 1/2003 Cairns et al. ..... 385/56
2005/0019725 A1 1/2005 Pagac
2005/0042903 A1 * 2/2005 Nicholson ..... 439/201
2006/0141846 A1 6/2006 Davis
2007/0224865 A1 * 9/2007 Fangrow ..... 439/205
2008/0299814 A1 * 12/2008 Rioufreyt et al. ..... 439/367
2009/0080836 A1 * 3/2009 Cairns et al. ..... 385/56
2009/0117762 A1 * 5/2009 Khemakhem ..... 439/136

FOREIGN PATENT DOCUMENTS

GB 2 405 267 2/2005
WO WO 2006/133824 12/2006

* cited by examiner

*Primary Examiner*—Ross N Gushi
(74) *Attorney, Agent, or Firm*—Muncy, Geissler, Olds & Lowe, PLLC

(57) ABSTRACT

The device for protecting a connector comprising two mutually engageable connector elements itself comprises for each connector element, a resilient tubular sleeve having one end configured to be fastened to a respective connector element by surrounding it in leaktight manner, and having a length at rest that is sufficient for it to be cantilevered out beyond one end of the connector element carrying the resilient sleeve, the cantilevered-out end including spring blades for flattening the sleeve and holding the corresponding lips pressed resiliently one against the other.

10 Claims, 3 Drawing Sheets

DEVICE FOR PROTECTING THE ENGAGEABLE ELEMENTS OF A CONNECTOR

The present invention relates to a device for protecting the engageable elements of a connector.

BACKGROUND OF THE INVENTION

It is known that a connector coated with mud is difficult to clean because access to certain portions of the connector is very constrained. Mud impedes mechanical and electrical operation of the connector.

In order to protect the mutually engageable elements of a connector against mud, regardless of whether the mud is splashed onto the connector element or the connector element becomes immersed in mud, proposals have been made to place a plug on the connector element or to provide a piston incorporated in the connector element and urged by a spring to a position in which the piston surrounds the connection members of the connector element so as to fill the space between the connection members, and thus prevent mud from penetrating between the connection members.

Such devices are not satisfactory. When a plug is used to protect a connector element, the plug needs to be withdrawn when the connector element is to be used for connection to another connector element. There is then a risk of the user, for lack of time, forgetting or omitting to put the plug back into place. The plug can also be lost, and even if it is attached to the connector element, there is a risk of it receiving mud or of being dropped into mud, so that it is no longer possible to close the connector element with the plug. When using a piston, mud runs the risk of accumulating in the interstices between the connection members and the piston, so that it rapidly becomes impossible to move the piston, and thus to disengage the connection members.

OBJECT OF THE INVENTION

An object of the invention is to provide a protection device that is easy to handle and that provides effective protection.

SUMMARY OF THE INVENTION

In order to achieve this object, the invention provides a device for protecting a connector comprising two engageable connector elements, the device comprising a resilient tubular sleeve for at least one connector element, the sleeve having one end fastened to a connector element and surrounding it in leaktight manner, and having a length at rest that is sufficient for it to be cantilevered out beyond one end of the connector element carrying the resilient sleeve, the cantilevered-out end having means for flattening the sleeve and holding the corresponding lips pressed resiliently against each other.

Thus, the resilient tubular sleeve remains permanently attached to the connector element it protects, and therefore it does not risk being lost, and it is opened at the moment of engagement with the other connector element in such a manner that the risk of mud penetrating into the inside of the protective sleeve is minimized.

In an advantageous version of the invention, the means for flattening the sleeve comprise at least one spring blade extending perpendicularly to a longitudinal direction of the sleeve and embedded in wall segments adjacent to the flat end. Thus, the force with which the lips are pressed against each other is increased.

According to another advantageous aspect of the invention, the spring blade includes curvature about an axis that is parallel to the spring blade, the curvature having a concave side facing towards the corresponding lip. Thus, the force holding the lips against each other is further increased.

According to another advantageous aspect of the invention, each spring blade is of width that decreases going from a central zone of the blade towards its ends. Thus, when the sleeve is opened, a circular shape is more easily obtained.

BRIEF DESCRIPTION OF THE DRAWINGS

Other characteristics and advantages of the invention appear on reading the following description of two particular, non-limiting embodiments, given with reference to the accompanying figures, in which.

DETAILED DESCRIPTION OF THE INVENTION

Figure 6:
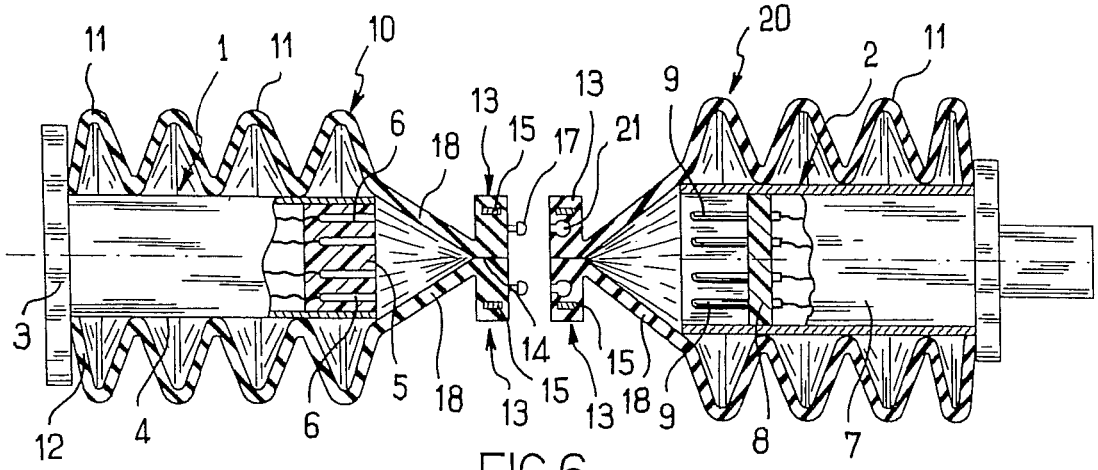
FIG. 6 is a diagrammatic section view on an axial plane showing two cylindrical connector elements fitted with a protective device of the invention and disposed facing each other, prior to engagement.

With reference to FIG. 6, the protective device of the invention is designed to protect a connector comprising two engageable connector elements 1 and 2. In the embodiment shown, the connector element 1 comprises a base 3 for fastening to an apparatus wall (not shown). A cylindrical bushing of circular section 4 is fastened to the base 3 and contains a connection member 5 having metal-plated holes 6 connected to connection wires. The connector element 2 comprises a cylindrical bushing of circular section 7 for mounting at the end of a cable, and containing a connection member 8 fitted with pins 9 coinciding with the metal-plated holes 6.

With reference to FIGS. 1 to 8, in a first embodiment of the invention, the connector element 1 is fitted with a resilient tubular sleeve 10, e.g. a rubber sleeve. At one end, the sleeve 10 has four concertina folds 11 of inside diameter preferably equal to or slightly greater than the diameter of the bushing 4, so as to enable the concertina folds 11 to slide easily on the bushing 4. Only the end wall of the last concertina folds has a diameter that is appropriate for enabling a force-fit on the bushing 4 so as to hold the sleeve 10 in place on the bushing 4.

At the end remote from the concertina folds, the resilient sleeve 10 has two pads 13, having inside edges that define lips 14 that are urged towards each other by spring blades 15 embedded in the rubber forming the pads 13. In the rest position shown in FIG. 1, the lips are rectilinear, forming a slot 16 that is closed in leaktight manner by the forces applied by the spring blades 15. The spring blades 15 are subjected to prestress that is obtained in this first embodiment by providing a decreasing thickness E (see FIG. 1) of material between a spring blade 15 and the corresponding lip 14 on going from the central zone of the spring blade towards its ends. The spring blades 15 are thus curved about an axis corresponding to the longitudinal axis of the sleeve 10. The pads 13 also include clip-fastener studs 17 that are cantilevered out beyond the pads 13 and that are used for a purpose explained below.

Figure 1:
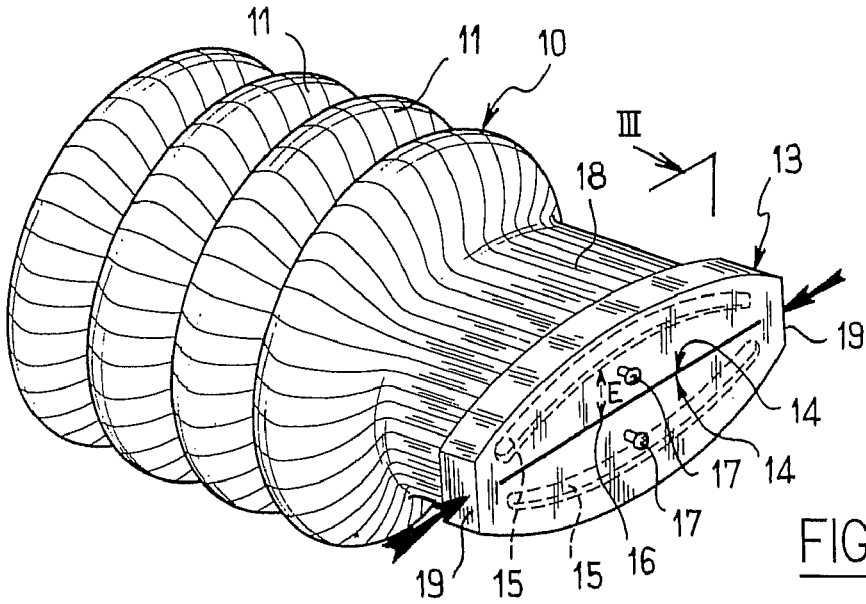
FIG. 1 is a perspective view in the closed position of a protective sleeve constituting a first embodiment of the invention.

In the rest position, the wall portion 18 of the resilient sleeve that connects the pads 13 to the first concertina fold 11 takes on a pseudo-conical shape, as can be seen in FIGS. 1 and 6.

Figure 2:
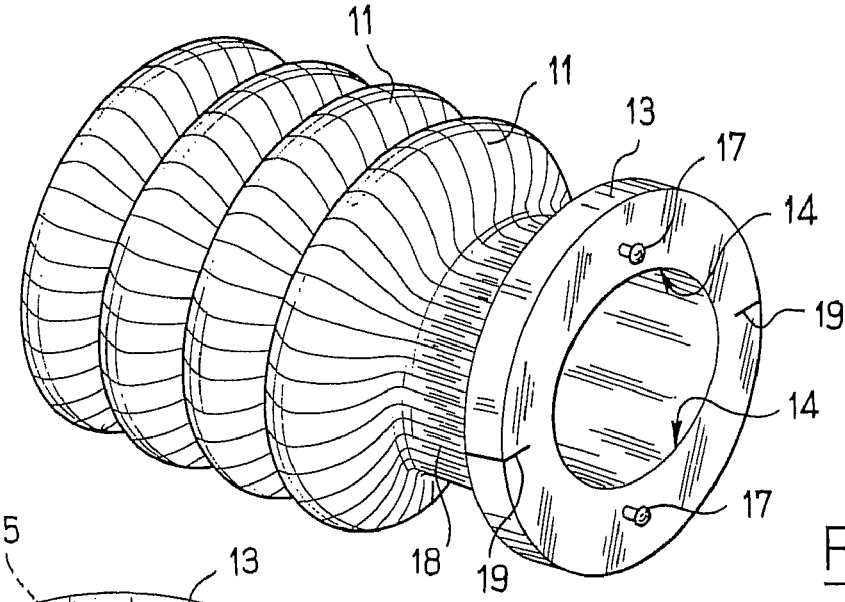
FIG. 2 is a perspective view analogous to the view of FIG. 1 showing the sleeve in the open position.
Figure 3:
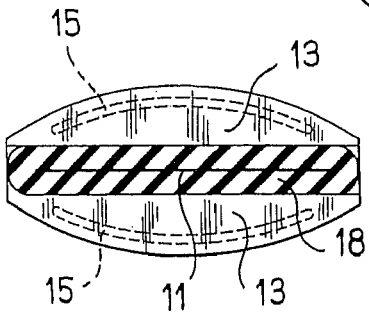
FIG. 3 is a section view on plane III of FIG. 1.
Figure 4:
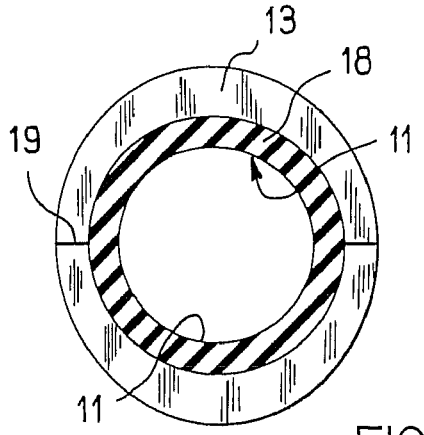
FIG. 4 is a section view analogous to that of FIG. 3, for an open position of the sleeve.

When a force is applied to the ends of the pads 13, as represented by bold arrows in FIG. 1, the spring blades 15 curve to a greater extent about the longitudinal axis of the resilient sleeve 10, and the lips 14 separate, taking up a curve that becomes ever more pronounced until the sleeve is fully opened, as shown in FIG. 2. It is also possible to open the sleeve by exerting a force to separate the inside walls of the sleeve portion 18, as explained below.

Figure 5:
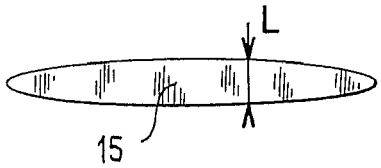
FIG. 5 is a plan view of a spring blade of the invention shown flat.

In this position, the lips 14 are preferably semicircular in shape, so as to match the outline of the bushing 4 of the connector element 1. For this purpose, and as shown in FIG. 5, the spring blades are preferably of width that decreases going from the central portions of the blades 15 towards their ends, in compliance with a sinusoidal relationship so as to obtain a return force that is constant at all points along the lips 14. In order to avoid extra thickness at the ends of the diameter corresponding to the rest position of the lips 14, the pads 13 preferably include flats 19 perpendicular to the slot 16. These flats are folded in half (see FIG. 4) when the sleeve is opened.

The resilient sleeve 20 providing protection for the connector element 2 is of structure identical to that of the sleeve 10, with the exception of the clip-fastener studs 17, which are replaced by clip-fastener cavities 21. Below, the same numerical references are given to portions that are identical, ignoring dimensions, given that the concertina folds 11 of the sleeve 20 have a diameter that matches the outside diameter of the bushing 7 of the connector element 2.

Figure 7:
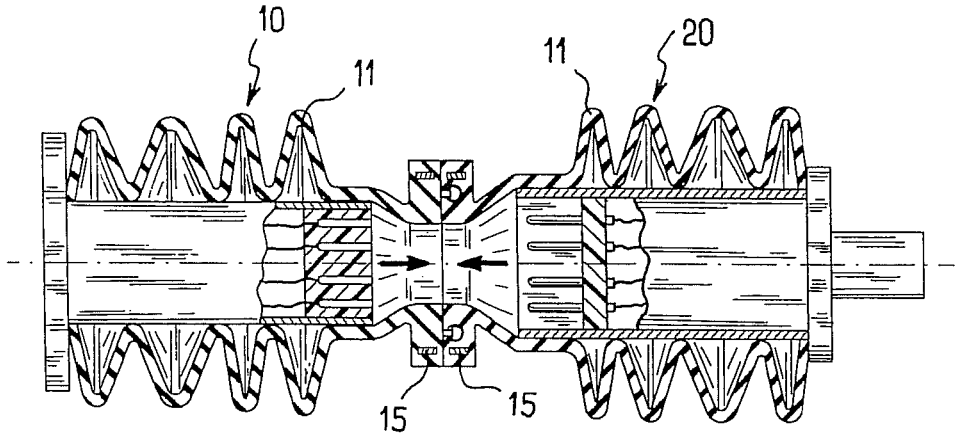
FIG. 7 is a view analogous to that of FIG. 6, in an intermediate stage during engagement.
Figure 8:
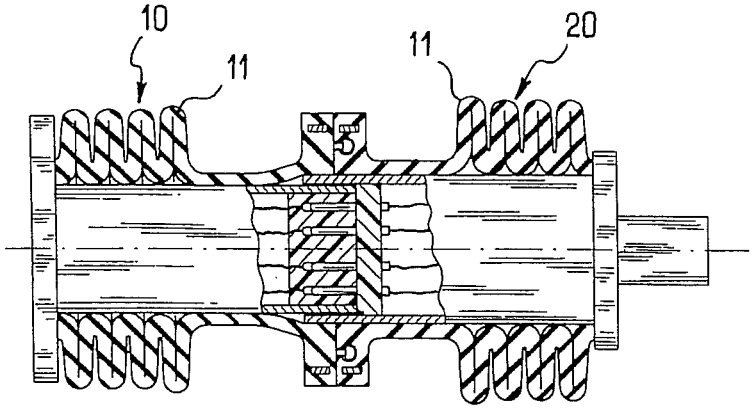
FIG. 8 is a view analogous to that of FIG. 6 for an engaged position of the connector elements.

As shown in FIG. 6, when the connector elements 1 and 2 are separated, the sleeves 10 and 20 close in leaktight manner. When it is desired to engage the connector elements, the slots 16 of each of the sleeves 10, 20 are presented facing each other so that the clip-fastener studs 19 of the sleeve 10 face the clip-fastener cavities 21 of the sleeve 20. Moving the connector elements towards each other causes the pads 13 to be clipped together so that they are subsequently secured to each other and therefore deform identically. Once the resilient sleeves 10 and 20 are clipped together, moving the connector elements 1 and 2 towards each other then causes the ends of the bushings 4 and 7 to bear against the corresponding inside faces of the sleeve portions 18. The wall portions 18 then open progressively causing the lips 14 to move apart until the moment when the passage is large enough to allow the connection members 5 and 8 to engage mutually, as shown in FIG. 8. In this movement, the concertina folds flatten progressively as shown in FIGS. 6 to 8. The sleeve portions 18 are sufficiently rigid to ensure that the connection force causes them to slide over the bushings 4, 7 without folding. The inside surfaces of the sleeve portions 18 and the outside surfaces of the bushings 4, 7 preferably have coefficients of friction that facilitates mutual sliding.

It should be observed that clipping the resilient sleeves 10 and 20 together serves not only to cause the lips 14 to open simultaneously, but also serves to pull each sleeve of the corresponding connector element when the connector elements are separated, thereby guaranteeing that the resilient sleeves return to the closed position when the connector elements are separated.

It should be observed that only the front surfaces of the pads 13 are in danger of being covered in mud. By cleaning these front surfaces, it is possible to avoid any mud penetrating to the insides of the resilient protective sleeves 10 and 20.

Figure 9:
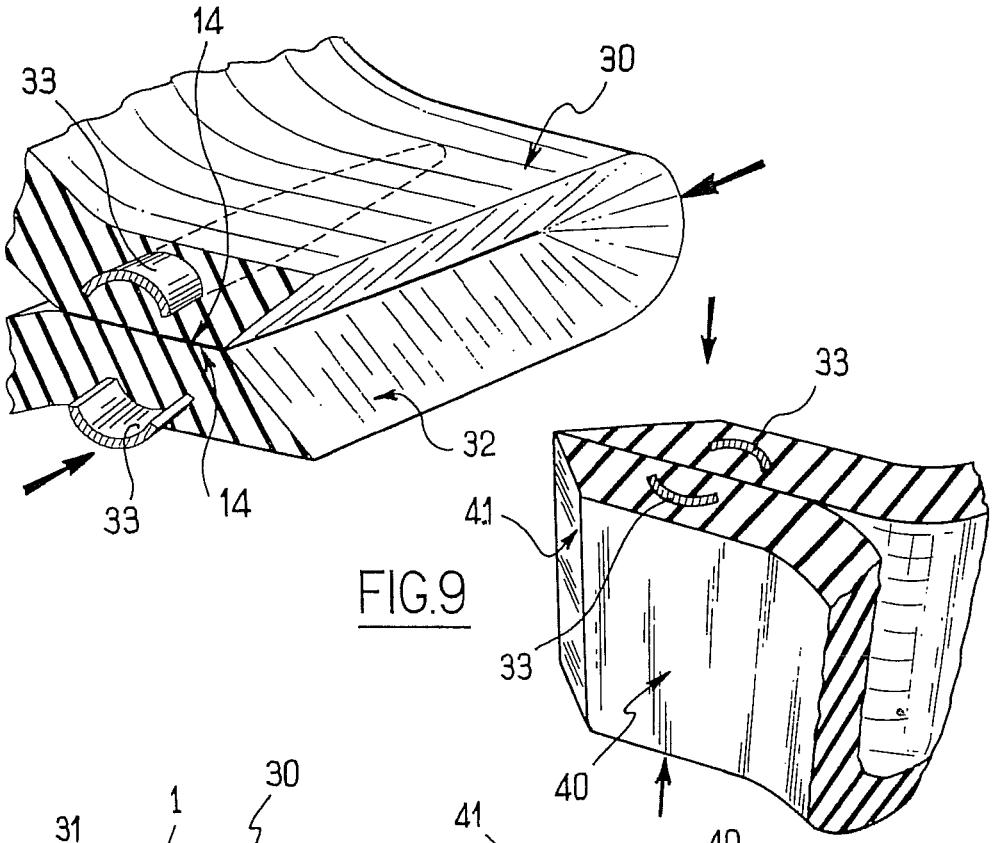
FIG. 9 is a fragmentary perspective view of a second embodiment of the invention.
Figure 10:
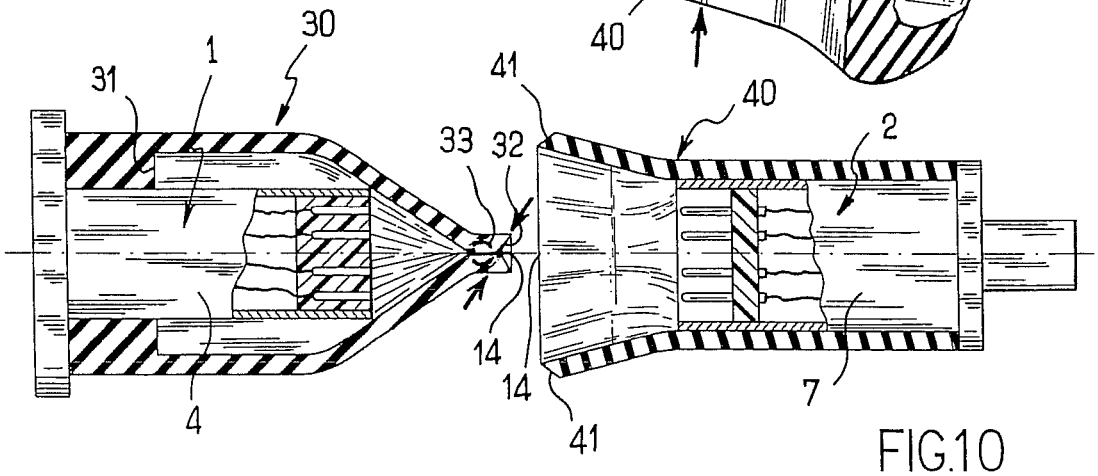
FIG. 10 is a section view analogous to that of FIG. 6 showing two connector elements in the second embodiment of the invention.
Figure 11:
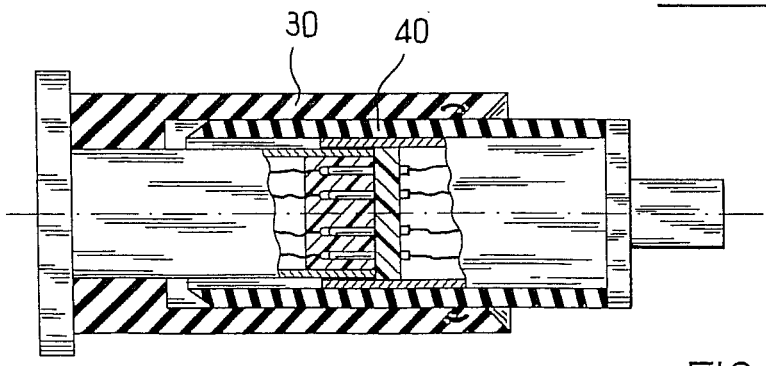
FIG. 11 is a section view analogous to that of FIG. 10, the connectors being shown in an engaged position.

In the second embodiment shown in FIGS. 9 to 11, the connector elements 1 and 2 are identical to those of the preceding figures, and they are therefore given the same numerical references. The protective sleeves 30 and 40 of the second embodiment no longer have concertina folds enabling the sleeves to be retracted as the connector elements move towards each other. In this embodiment, when the sleeve 40 surrounding the connector element 2 is in the open position, it constitutes a cylindrical sleeve having a wall of thickness that is constant, with the exception of an outwardly-directed chamfer at its end facing towards the corresponding end of the protective sleeve 30.

The sleeve 30 also has a wall that is cylindrical in the open position, but it further includes an inside shoulder 31 enabling the sleeve 40 to penetrate into the sleeve 30 during engagement of the connector elements 1 and 2. The sleeve 30 also has a chamfer 32 at its end facing the sleeve 40, the chamfer 32 facing inwards. As before, the protective sleeve 30 includes spring blades 33 that extend perpendicularly to the longitudinal direction of the resilient sleeves. However, in this embodiment, at rest, the spring blades 33 are rectilinear in planes parallel to the lips 14, while being curved about an axis that is parallel to the spring blades, the curvature having its concave side directed towards the corresponding lip 14. In order to obtain a regular circular shape for the lips 14 on opening the sleeves, the spring blades 33 are preferably analogous in shape in plan view to the spring blades 15 of the first embodiment.

Given the interpenetration of the sleeves 30 and 40, it is no longer possible to clip together the facing edges of the protective sleeves 30 and 40. To encourage penetration when the ends of the sleeves 30 and 40 are pressed in engagement one against the other, the lips 14 in the closed position are now disposed in perpendicular planes as shown in FIGS. 9 and 10. Forces represented by bold arrows in FIGS. 9 and 10 are exerted manually on the ends of the slots 16 to cause the sleeves 30 and 40 to open, with continued opening and penetration of the sleeves one in the other being facilitated by the chamfers 32 and 41.

The invention is not limited to the embodiments described, and various embodiments can be provided without going beyond the ambit of the invention as defined by the claims.

In particular, although the springs 15 and 33 are shown as being in the form of two separate springs, they could be in the form of a one-piece ring, or they could be united by hinges at their ends. The sleeves of the invention can also be made without spring blades, by providing the sleeves with a flat shape when they are made, such that they are returned automatically thereto when in the rest position.

Although the concertina folds in the first embodiment are shown as having identical inside and outside diameters, such that the sleeves are retracted by flattening the folds, it is possible to provide concertina folds of frustoconical shape so that the folds become engaged one within another during retraction.

The number of folds need not necessarily be four.

Although the invention is shown with reference to connector elements, each covered by a protective sleeve of the invention, it is possible to make provision for associating a protective sleeve of the invention with only one of the elements of the connector, e.g. the element connected to a cable, while the other connector element is protected in conventional manner, e.g. by a plug for the connector element that is mounted on the apparatus that is less likely to receive mud.

To encourage sliding of the bushings relative to the sleeves, provision can be made to cover the contacting surfaces in polytetrafluoroethylene (PTFE) or the like. For this purpose, it is possible to use a PTFE tape that may also serve to stiffen the element on which it is fastened.

In a variant, it is possible to provide localized stiffener elements (ribs, local reinforcement, whether fitted or integral, such as plates of material, a mesh or grid of ribs, . . . ), in particular on the sleeve portions 18, in order to encourage the sleeve portions 18 to deform in a given direction (opening when making a connection). Conversely, zones of preferred deformation may be provided for the same purpose (such as zones of smaller thickness or non-through slots).

What is claimed is:

1. A device for protecting a connector comprising two engageable connector elements, the device comprising a resilient tubular sleeve for at least one connector element, the sleeve having one end fastened to a connector element and surrounding it in leaktight manner, wherein the resilient sleeve is of a length at rest that is sufficient for it to be cantilevered out beyond one end of the connector element carrying the resilient sleeve, the cantilevered-out end having means for flattening the sleeve and holding the corresponding lips pressed resiliently against each other; and wherein the means for flattening the sleeve comprise at least one spring blade extending perpendicularly to a longitudinal direction of the sleeve and embedded in wall segments adjacent to the flat end.

2. A device according to claim 1, wherein, in a longitudinal direction of the resilient sleeve, said at least one spring blade is of width that decreases from a central zone of the blade towards the ends thereof.

3. A device according to claim 1, including prestress means for exerting a force on the blades in a direction that increases thrust of the lips against each other.

4. A device according to claim 3, wherein the prestress means comprise decreasing thickness of material between a spring blade and the corresponding lip, going from the central zone of the spring blade towards the ends thereof.

5. A device according to claim 3, wherein the prestress means comprise curving at least one spring blade about an axis parallel to the spring blade, the curvature having its concave side directed towards the corresponding lip.

6. A device according to claim 5, including two resilient sleeves, each mounted on a respective connector element, and wherein the sleeves are of different diameters, enabling the resilient sleeves to interpenetrate during mutual engagement of the connector elements.

7. A device according to claim 6, wherein at least one of the resilient sleeves has a lip including a chamfer encouraging the resilient sleeves to interpenetrate one in the other.

8. A device for protecting a connector comprising two engageable connector elements, the device comprising two resilient tubular sleeves each mounted on a respective connector element, the sleeves having one end fastened to a connector element and surrounding it in leaktight manner, wherein each resilient sleeve is of a length at rest that is sufficient for it to be cantilevered out beyond one end of the connector element carrying the resilient sleeve, the cantilevered-out end having means for flattening the sleeve and holding the corresponding lips pressed resiliently against each other;

wherein both resilient sleeves have clip-fastener means for fastening the flat ends together; and wherein each sleeve has a wall including at least one fold.

9. A device according to claim 8, wherein the clip-fastener means comprise a stud projecting from a flat end of one sleeve and placed so as to co-operate with a corresponding cavity in a facing sleeve.

10. A device according to claim 9, wherein each lip has clip-fastener means for fastening with a corresponding lip.

* * * * *